US007748713B2

(12) United States Patent
O'Neill

(10) Patent No.: US 7,748,713 B2
(45) **Date of Patent: *Jul. 6, 2010**

(54) METHOD AND APPARATUS FOR GAME PLAY

(76) Inventor: John Edward O'Neill, 3375 Alma St., #374, Palo Alto, CA (US) 94306

( * ) Notice: Subject to any disclaimer, the term of this patent is extended or adjusted under 35 U.S.C. 154(b) by 12 days.

This patent is subject to a terminal disclaimer.

(21) Appl. No.: 11/585,575

(22) Filed: Oct. 23, 2006

(65) Prior Publication Data

US 2007/0035088 A1 Feb. 15, 2007

Related U.S. Application Data

(63) Continuation-in-part of application No. 10/821,754, filed on Apr. 9, 2004, now Pat. No. 7,568,699.

(60) Provisional application No. 60/729,843, filed on Oct. 24, 2005, provisional application No. 60/462,494, filed on Apr. 11, 2003.

(51) Int. Cl.
*A63F 3/00* (2006.01)

(52) U.S. Cl. ..... 273/258; 273/261; 273/288

(58) Field of Classification Search ..... 273/258, 273/260, 261, 288, 289, 290
See application file for complete search history.

(56) References Cited

U.S. PATENT DOCUMENTS

| | | | | |
|---|---|---|---|---|
| 1,578,554 A | | 3/1926 | Seligman | |
| 3,274,727 A | | 9/1966 | Zander | 46/16 |
| 3,406,975 A | | 10/1968 | Berger | 273/136 |
| 3,610,626 A | | 10/1971 | Nolte | 273/131 |
| 3,951,411 A | | 4/1976 | Hill et al. | 273/134 AD |
| 3,973,775 A | | 8/1976 | Bolan et al. | 273/134 AA |
| 4,046,381 A | | 9/1977 | Comeaux | 273/134 AD |
| 4,093,237 A | | 6/1978 | Weiss | 273/260 |
| 4,249,740 A | | 2/1981 | Cheney et al. | 273/260 |
| 4,306,724 A | | 12/1981 | Brzezinski et al. | 273/243 |
| 4,341,386 A | | 7/1982 | Kleva | 273/239 |
| 4,498,674 A | * | 2/1985 | Ferris et al. | 273/243 |
| 4,625,971 A | | 12/1986 | Ferguson | 273/272 |
| 4,645,209 A | * | 2/1987 | Goulter et al. | 273/271 |
| 4,842,281 A | | 6/1989 | Turner | 273/256 |
| 5,100,149 A | | 3/1992 | Olfman et al. | 273/241 |

(Continued)

FOREIGN PATENT DOCUMENTS

GB 2202453 A 9/1988

*Primary Examiner*—Vishu K. Mendiratta
(74) *Attorney, Agent, or Firm*—Haverstock & Owens LLP

(57) ABSTRACT

A gaming apparatus for allowing players to explore decisions made in response to changing circumstances and to engage with the contradictions of competing needs. The gaming apparatus comprises a game board and game pieces. The game board is divided into an inner play area and an outer play area that surrounds the inner play area. An outer game piece traversing the outer play area determines functionality of one or more inner game pieces positioned on the inner play area. In each round of a game play, a player is either a Giver or a Taker, and moves inner game pieces according to their Point of View. Players' Points of View may exchange in every round. A player's goal is to be the Giver, since only the Giver can win. However, the Giver only wins when all four blue human being game pieces from a pyramid and meet Eye to Eye.

19 Claims, 9 Drawing Sheets

U.S. PATENT DOCUMENTS

| | | | | |
|---|---|---|---|---|
| 5,195,750 | A | 3/1993 | Courialis | 273/241 |
| 5,556,099 | A * | 9/1996 | Mardirosian | 273/241 |
| 6,120,029 | A | 9/2000 | Carmichael et al. | 273/260 |
| 6,419,228 | B1 | 7/2002 | Egli et al. | 273/236 |
| D479,283 | S | 9/2003 | Heil | D21/372 |
| D483,414 | S | 12/2003 | Wilson, Sr. | D21/322 |
| 6,669,196 | B1 | 12/2003 | Washko | 273/243 |
| 6,669,197 | B1 | 12/2003 | Lund et al. | 273/243 |
| 6,688,596 | B2 | 2/2004 | Nielsen | 273/120 R |
| 6,692,002 | B2 | 2/2004 | Kummer | 273/272 |
| 6,817,613 | B2 | 11/2004 | Hasek | 273/256 |
| 2003/0094759 | A1 | 5/2003 | Niedner et al. | 273/255 |
| 2004/0201171 | A1 | 10/2004 | O'Neill | 273/260 |
| 2005/0017447 | A1 | 1/2005 | Geshwind | 273/236 |

* cited by examiner

300

| | | | | | | | |
|---|---|---|---|---|---|---|---|
| 37 | 38 | 39 | 40 | 41 | 42 | 43 | 44 |
| 64 | 1 | 2 | 3 | 16 | 17 | 10 | 45 |
| 63 | 8 | 9 | 4 | 15 | 18 | 11 | 46 |
| 62 | 7 | 6 | 5 | 14 | 13 | 12 | 47 |
| 61 | 21 | 22 | 23 | 32 | 33 | 34 | 48 |
| 60 | 20 | 27 | 24 | 31 | 36 | 35 | 49 |
| 59 | 19 | 26 | 25 | 30 | 29 | 28 | 50 |
| 58 | 57 | 56 | 55 | 54 | 53 | 52 | 51 |

305

310

Fig. 3

METHOD AND APPARATUS FOR GAME PLAY

CROSS REFERENCE TO RELATED APPLICATIONS

The application claims priority of U.S. provisional application, Ser. No. 60/729,843, filed Oct. 24, 2005, and entitled "Method and Apparatus for Gameplay," by this same inventor. This application incorporates U.S. provisional application, Ser. No. 60/729,843 in its entirety by reference. This application is a continuation-in-part application of U.S. application, Ser. No. 10/821,754, filed Apr. 9, 2004 now U.S. Pat. No. 7,568,699 and entitled "Board Game And Method Of Playing Thereof," which in turn claims priority of U.S. provisional application, Ser. No. 60/462,494, filed Apr. 11, 2003, and entitled "Admcadiam Paradice," by this same inventor. This application incorporates U.S. provisional application, Ser. No. 60/462,494 in its entirety by reference. This application incorporates U.S. provisional application, Ser. No. 10/821,754 in its entirety by reference.

FIELD OF THE INVENTION

The present invention relates to the field of games. More particularly, the present invention relates to the method and apparatus for game play of give and take.

BACKGROUND OF THE INVENTION

Board games are known for providing challenge and enjoyment to users. New games that simulate aspects of real life are desired.

SUMMARY OF THE INVENTION

The instant invention allows players to explore decisions made in response to changing circumstances and to engage with the contradictions of competing needs. This instant invention also allows players to explore, exchange, and benefit from different points of view, creating a safe place to enable conversation and provide the players growth and self-discovery.

A gaming apparatus is preferably configured for a two-person game play. The gaming apparatus has a game board and a plurality of game pieces. Preferably, the game board has a playing surface that is divided into an inner play area and an outer play area. In some embodiments, the inner play area is a surface of 6×6 array of squares divided into four quadrants. Each quadrant is a 3×3 array of squares. The outer play area is a perimeter of 28 squares which surround the inner play area. In some embodiments, the game board is further configured with a raised inner play area relative to the outer play area. The outer play area acts as a game engine, controlling the functionality of one or more game pieces within the inner game area.

The plurality of game pieces includes inner games pieces. The inner game pieces are set up and played within the inner play area. In some embodiments, the inner game pieces include four different types of forest tree game pieces, four different colored forest spirit game pieces, four colored human-being game pieces, two transparent forest spirit game pieces, and two transparent human-being game pieces. Each type of forest trees has a corresponding forest spirit, preferably designated by a specific color. In some embodiments, the four colored human-being game pieces are blue. Preferably, each colored human-being game piece is shaped as one-quarter of a pyramid with two flat vertical sides, two flat sloped sides, and two eyes. When two colored human-beings fit together, they meet Eye to Eye. When all four colored human-being game pieces fit together Eye to Eye, a pyramid is formed.

At the start of a game, each quadrant preferably defines a forest comprising forest trees of one type supporting its forest spirit and a human-being observing the world from a different point of view. For example, a first colored forest spirit associated with a first type of forest tree is placed in the center of a quadrant. A colored human-being game piece faces in from the outer corner of the quadrant. Forest trees of the first type are placed in the rest of the squares of the quadrant surrounding the first colored forest spirit. The four forests in the inner play area represent an analogy to earth.

The plurality of game pieces further includes at least one outer game piece, random number generator such as a die, and a mask. Preferably, a single outer game piece is used. In some embodiments, the outer game piece, initially placed anywhere on the outer play area, moves around the outer play area during game play. Preferably, the outer game piece moves clockwise around the outer play area. Alternatively, the outer game piece moves counter-clockwise around the outer play area. The position of the outer game piece on the outer play area determines both functionality and ownership of the inner game pieces positioned within the inner play area. As such, functionality and ownership of the inner game pieces on the inner play area are in a constant state of change relative to the change of position of the outer game piece on the outer play area.

Before a game play begins, each player is assigned by an initial role of one or more die or by other form of selection, as a Giver or as a Taker, based on randomly generated numbers. In some embodiments, a die is used to randomly generate numbers. The player with the higher rolled number starts the game as the Giver, and the other player starts the game as the Taker. Preferably, the objective of the game play is to become the Giver since the Taker cannot win the game play but can end the game play by preventing the Giver from winning and gain the opportunity to become the Giver and win.

As the Taker, the player tries to prevent the four colored human-being game pieces from meeting Eye to Eye by disrupting the colored human-beings from coming together or displaces them away from each other and by removing all trees from at least two forests or displacing forest spirits from their supporting trees. When all trees from at least two forests are removed from the inner play area before the four colored human-beings meet Eye to Eye, the Giver can no longer win. Accordingly, the game is reset by setting up the game board anew, and the players exchange roles before playing a new game play.

In contrast, as the Giver, the player tries to move all four colored human-being game pieces together to meet Eye to Eye and form the pyramid before all of the trees from at least two forests are removed from the inner play area by the Taker. Preferably, only the Giver can win the game play, and the Giver only wins when all four colored human-being game pieces meet Eye to Eye by forming the pyramid.

The game play is divided into a series of rounds. Typically, rounds are played until the game play ends. Each round of the game play preferably includes three parts. In the first part of a round, a random number is generated. If a one is rolled, then the players exchange roles before the round continues. The original Giver now becomes the new Taker, and the original Taker now becomes the new Giver. In some embodiments, the die is round and is placed on a base portion of the outer game piece. The outer game piece with the die moves around the outer play area of squares by the number rolled. In some embodiments, the mask is placed on a colored human-being game piece nearest to the outer game piece to indicate the Taker's playing piece during the round. Accordingly, the remaining three unmasked colored human-being game pieces are played by the Giver.

In some embodiments, the Taker moves first before the Giver moves in a round. The Taker starts the second part of the round with a number of moves equal to the number rolled in the first part of the round. Preferably, by using the masked human-being, the Taker tries to stop the unmasked colored human-beings from forming a pyramid. The Taker also tries to reset the game by removing all of the trees from at least two forests, in order to become the Giver in a new game with the chance to win.

If the Taker has not already ended the game play, the Giver starts the third part of the round with the same number of moves as the Taker had in the second part of the round. Preferably, by using any of the unmasked colored human-beings or colored forest spirits as a playing piece, the Giver tries to form a pyramid by moving all three unmasked colored human-beings together and then capturing the fourth, removing their mask and bringing together with the other three. The Giver wins when all four colored human-beings meet Eye to Eye before all the trees from at least two forests are removed. During the game play, the Giver also tries to keep the colored forest spirits and unmasked colored human-beings from being removed off the inner play area by the Taker.

Once the Giver finishes the third part of the round, it is determined whether another round is needed to complete the game play. Preferably, the game play ends when the Giver successfully makes all four colored human-being game pieces meet Eye to Eye, in which the Giver wins the game play. Alternatively, the game play ends when the Taker successfully resets the game play by removing all trees from at least two forests in order to become the Giver in a new game with the chance to win. Otherwise, the game play continues and the die is rolled again to start a new round.

BRIEF DESCRIPTION OF THE DRAWINGS

FIG. 3 illustrates an embodiment of the game board of the gaming apparatus used in the present invention.

DETAILED DESCRIPTION

Figure 1:
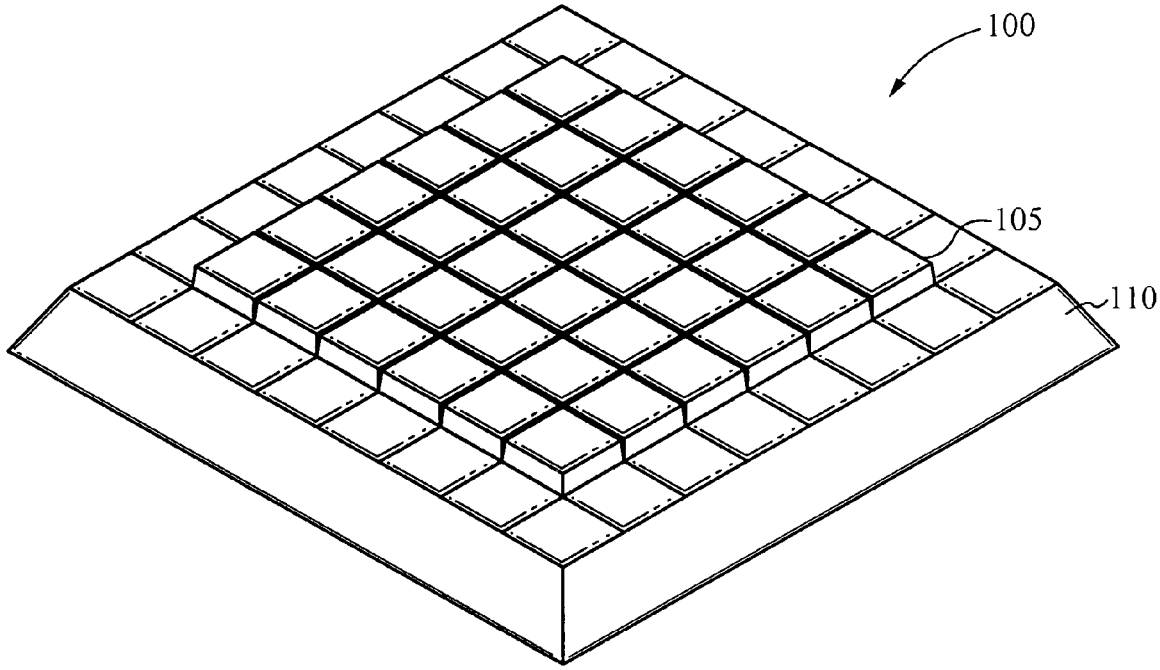
FIG. 1 illustrates a top down isometric view of the game board of the gaming apparatus of the present invention.

A gaming apparatus preferably includes a game board and a plurality of game pieces. In some embodiments, an inner playing area of the game board, referred to as Paradice, comprises 36 squares placed in a 6×6 array. An outer playing area around the perimeter of the inner playing area, referred to as a Universe Interface, comprises 28 squares. In each 3×3 quadrant of the inner playing area, forest trees surround a life form referred to as a forest spirit. Each quadrant preferably comprises seven forest trees of the same type, one forest spirit associated with the forest tree type, and a human-being with a perspective, referred to as a Point of View, looking in from a corner of Paradice. An outer game piece, referred to as a Circumstance Changer, initially occupies any square within the Universe Interface. In some embodiments, a die is used as a random number generator.

Each forest supports a different colored forest spirit. Accordingly, a colored forest spirit must be next to a tree of its forest to be active (flourishing). Each human-being responds to an Opportunity in one of two ways, as a Taker or as a Giver. As a Taker, a human-being takes forest trees from and displaces other game pieces in Paradice. As a Giver, a human-being seeks to maximize the health of Paradice by returning forest trees, reviving forest spirits, and forming a pyramid. One or more human-beings' Points of View change throughout a game play. The purpose of the game play is for the Giver to unite all of the human-beings to meet Eye to Eye, and to share the values and visions, before the Taker ends the game.

It is the specific location of the Circumstance Changer on the Universe Interface that defines the role of each human-being during game play. To determine the resting location of the Circumstance Changer, the die is rolled. The number rolled is referred to as the Opportunity for the round. In some embodiments, the Opportunity is placed inside the Circumstance Changer. The Circumstance Changer moves around the Universe Interface according to the Opportunity. In some embodiments, the Circumstance Changer moves clockwise around the Universe Interface clockwise. Preferably, an indicator is placed on a human-being nearest to the location of the Circumstance Changer to indicate the Taker's playing piece. In the preferred embodiment, the indicator is a mask, referred to as a Taker Mask.

The game play is played in rounds. Preferably, each round is divided into three parts. In some embodiments, the Taker takes the Opportunity first before the Giver does in each round. The game play is a dialogue between the Taker and the Giver as each uses Opportunity. As such, the game play allows the players to explore decisions made in response to changing circumstances and to engage with the contradictions of competing needs.

The chart below defines terms used in Paradice.

| | |
|---|---|
| Active | All colored human-beings and colored spirits begin the game as active game pieces. Active game pieces are considered flourishing in Paradice. |
| Deactivate | The Taker can deactivate a colored forest spirit by:<br>Taking all the trees of its forest<br>Displacing a colored forest spirit so that it is not next to any tree of its forest<br>When a colored forest spirit is deactivated, the colored human-being nearest to the deactivated forest spirit is also deactivated in the same move. Both |

-continued

| | |
|---|---|
| | deactivated game pieces are replaced with their transparent counterparts. Deactivated game pieces are considered floundering in Paradice. |
| Reactivate | The Giver can reactivate (restore) a forest spirit by<br>Giving a tree back to its forest<br>Moving a deactivated forest spirit next to a tree of its forest<br>When a forest spirit is reactivated, the human-being deactivated with it is reactivated in the same move. Both transparent pieces are exchanged with an appropriate colored forest spirit and a colored human-being. |
| Pyramid | The four colored human-being game pieces fit together Eye to Eye to form a pyramid. The Giver who makes this happen wins the game. |
| Eye to Eye | Colored human-beings have eyes that fit together when they align according to a specific orientation of each adjacent piece. Unless the eyes of adjacent colored human-beings fit together, they are not Eye to Eye. |
| Displace | Any masked or active unmasked colored human-being can be moved onto an occupied square and displace the piece thereby changing position with it. The displaced piece goes to the square the player's piece moved from. |
| Nearest | The nearest is determined by counting squares in either direction but not diagonally. If the Circumstance Changer stops equidistant between:<br>The masked human-being and an unmasked colored human-being, the Taker chooses which one to mask.<br>Two unmasked colored human-beings that are nearer than the masked human-being, the Taker chooses which of the two unmasked colored human beings to mask.<br>When a colored forest spirit is deactivated and is equidistant between two unmasked colored human-beings, the Taker chooses which unmasked colored human-being to deactivate. |
| Next to | A forest spirit is active when it is next to a tree of its forest, which means adjacent to or touching diagonally at least one tree of its forest. However, when a tree is given back to its forest it can only be placed adjacent to a tree of the same type. A tree may be placed adjacent or diagonally next to its forest spirit. |
| One | A random number generation of one changes the Points of View of the players. Players exchange roles. |
| Opportunity | Opportunity is the number rolled. It determines the number of moves in each round and the human-being's Points of View. |
| Reset | The Taker removes all the trees of two forests, which automatically deactivates two colored forest spirits and two colored human-beings. The Giver can no longer win. Players set up the game board anew and exchange Points of View. The Taker becomes the Giver and has the chance to win. |

I. Apparatus for Game Play

Figure 2:
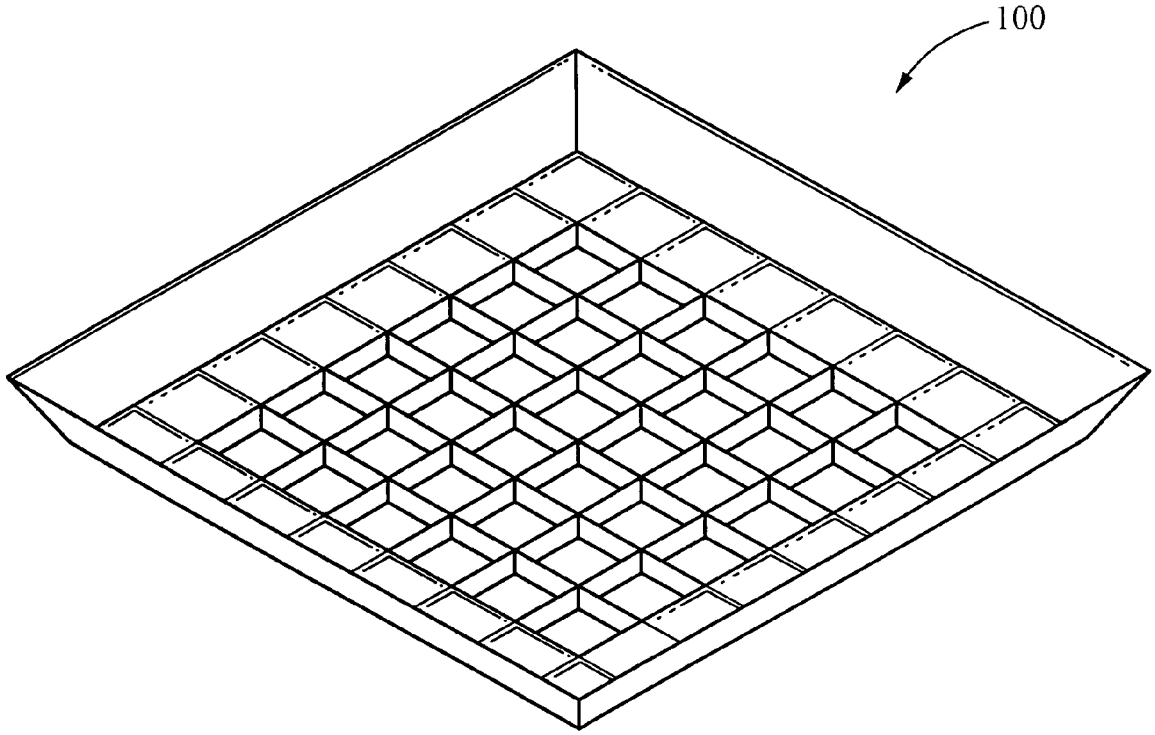
FIG. 2 illustrates a bottom up isometric view of the game board of the gaming apparatus of the present invention.

A gaming apparatus includes a game board. FIG. 1 illustrates an exemplary game board 100. The game board 100 has a playing surface that is divided into an inner play area 105 and an outer play area 110. The inner play area 105 is a raised surface of 6×6 array of squares. The inner play area 105 is referred to as Paradice. The outer play area 110 is a perimeter of 28 squares which surrounds the raised inner play area 105. The outer play area 110 is referred to as a Universe Interface. While FIG. 1 illustrates a top-down perspective view of the game board 100, FIG. 2 illustrates a bottom-up perspective view of the game board 100.

FIG. 3 illustrates the preferred game board 300 with Paradice 305 divided into four quadrants. In some embodiments, each quadrant is a 3×3 array of squares. A first quadrant includes squares 1-9. A second quadrant includes squares 10-18. A third quadrant includes squares 19-27. A fourth quadrant includes squares 28-36. FIG. 3 also illustrates a Universe Interface 310 of 28 squares surrounding Paradice 305. The Universe Interface 310 has squares 37-64.

Figure 4:
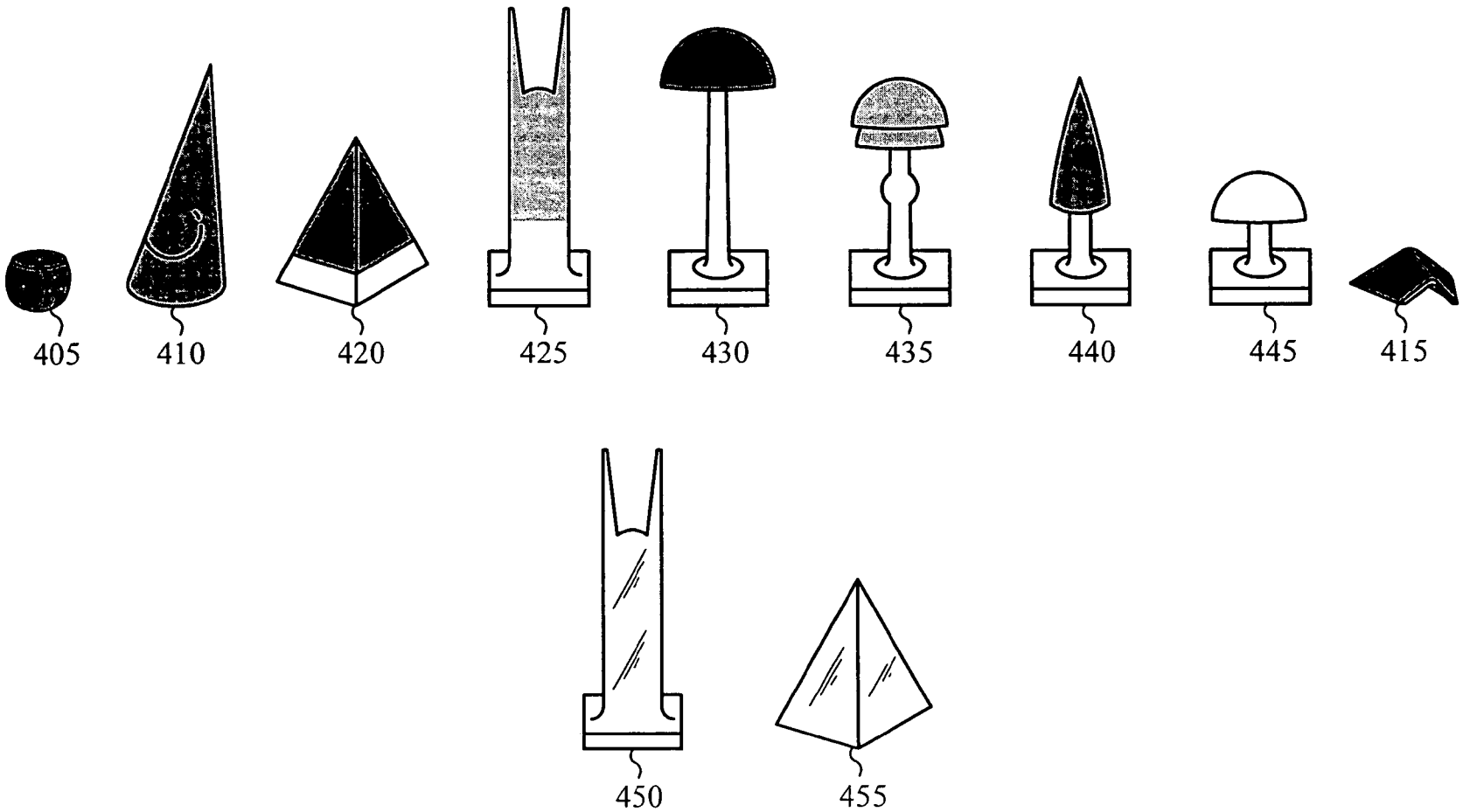
FIG. 4 illustrates game pieces of the gaming apparatus of the present invention.

The gaming apparatus also includes a plurality of game pieces. FIG. 4 illustrates the plurality of game pieces used according to one embodiment of the present invention. The plurality of game pieces includes inner games pieces, such as four different types of forest tree game pieces 430, 435, 440, 445 where each type of forest includes seven game pieces, four different colored forest spirit game pieces 425, four colored human-being game pieces 420, two transparent forest spirit game pieces 450, and two transparent human-being game pieces 455. Preferably, one or more of these inner game pieces are set up and played within Paradice. Each of the inner game pieces moves horizontally or vertically but not diagonally within Paradice.

In some embodiments, the four types of forest trees include Rainforest trees 430, Palm trees 435, Coniferous trees 440, and Deciduous trees 445. It will be apparent to those of ordinary skill in the art that other types of objects or life forms can be played. Examples include Heath trees, Peat trees, Várzea trees, and Mangrove trees. Each type of forest trees supports a forest spirit 425, each of which is preferably designated by a different color. In some embodiments, Palm trees support a yellow forest spirit, Coniferous trees support a violet forest spirit, Rainforest trees support a red forest spirit, and Deciduous trees support an orange forest spirit. It is understood that the four colors used to associate the forest spirits with the forest trees are for exemplary purposes only.

Figure 5:
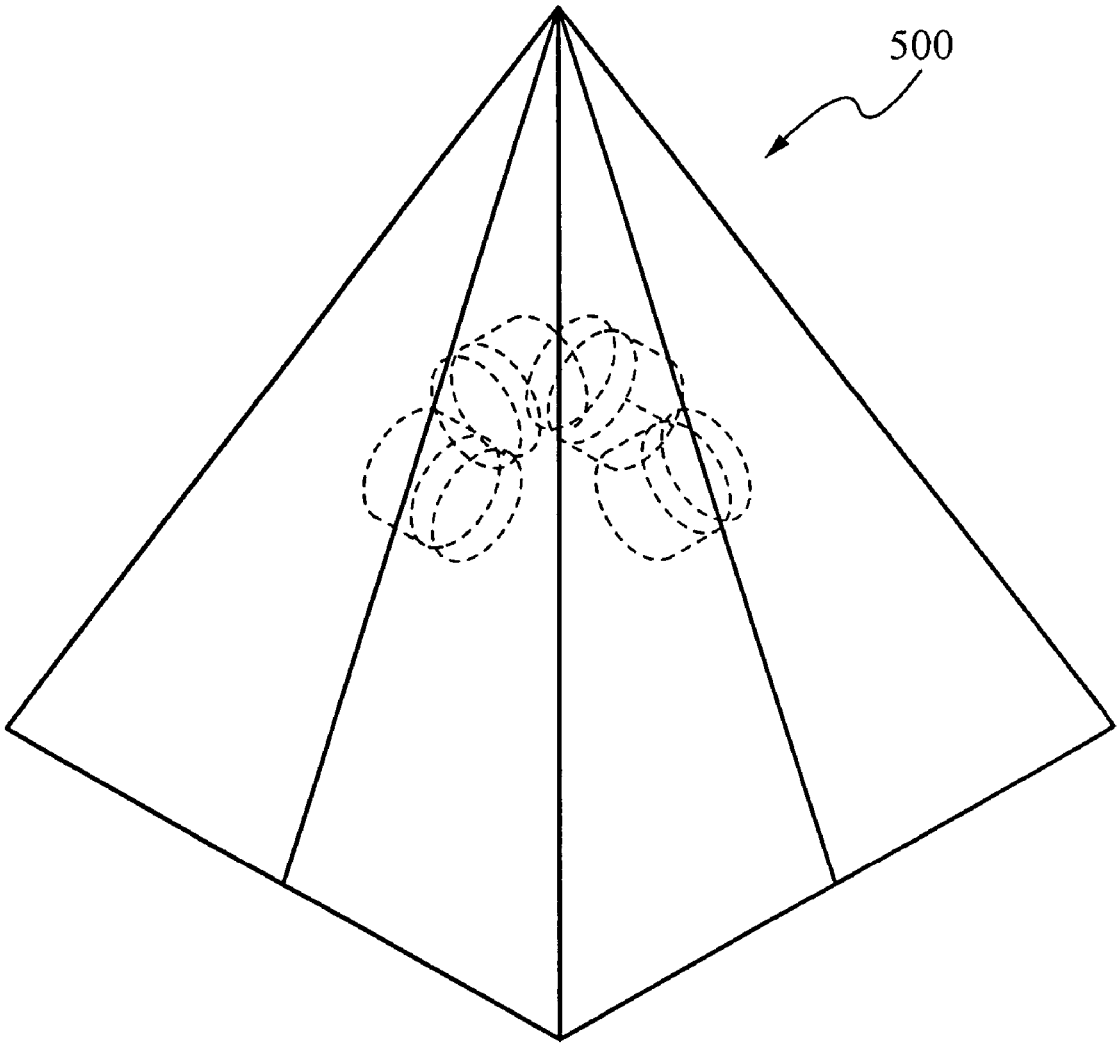
FIG. 5 illustrates an isometric view of four human-being game pieces of the gaming apparatus seeing Eye to Eye by forming a pyramid.

In some embodiments, the colored human-being game pieces 420 are colored blue. Each colored human-being game piece 420 is shaped as one-quarter of a pyramid with two flat vertical sides, two flat sloped sides, and two eyes. The top of each colored human-being game piece is considered its head. The two flat vertical sides are considered its front. The two flat sloped sides are considered its back. Preferably, each colored human-being game piece has two eyes, one eye extends outwardly from the surface of one front side and the other eye is concave within the surface of the other front side to receive the extending eye from another colored human-being game piece. When front sides of two adjacent colored human-being game pieces face each other, the two colored human-beings meet Eye to Eye. The two colored human-beings do not meet Eye to Eye when the front side of one colored human-being game piece is facing the back side of the other colored human-being game piece. In particular, unless the eyes of all colored human-being game pieces fit together, they are not Eye to Eye and do not form the pyramid. When all four colored human-being game pieces fit together to form a pyramid, the backs, or flat sloped sides, form the outer faces of the pyramid. In some embodiments, the formed pyramid is colored blue. FIG. 5 illustrates the formed pyramid 500 used in some embodiments of the present invention.

Preferably, each colored human-being game piece remains pointing in its initial direction throughout the game play, unless a move is specifically made to rotate the orientation of a colored human-being game piece. Each move specifically made to rotate the orientation of a colored human-being game piece by 90 degrees costs one move. Moves are discussed in greater detail below.

As FIG. 4 illustrates, the plurality of game pieces further includes a die 405, at least one outer game piece 410, and a mask 415. In some embodiments, the die is used to randomly generate a number. A rolled number on the die is referred to as an Opportunity. The Opportunity assigns players' initial roles of the game. Player roles are referred to as Points of View. Alternatively, the Opportunity reassigns the players' Points of View during game play. Alternatively, the Opportunity specifies the number of moves in each round. However, it will be apparent to those of ordinary skill in the art that other means for randomly generating a number to determine the number of moves in each round can be used. For instance, a numbered spinner can be used instead for determining the number of moves in each round. Rounds are discussed in greater detail below.

In some embodiments, after the die is rolled, the die is placed on a base portion of the at least one outer game piece 410 with the Opportunity up. Preferably, a single outer game piece is used. The outer game piece 410 is referred to as a Circumstance Changer.

The Circumstance Changer 410 is initially placed anywhere on the Universe Interface and moves on the Universe Interface by the Opportunity. In some embodiments, the Circumstance Changer moves clockwise on the Universe Interface. It will be apparent to those of ordinary skill in the art that the Circumstance Changer can move around the Universe Interface in a different fashion, such as counter-clockwise. Preferably, the position of the Circumstance Changer 410 on the Universe Interface determines functionality of the inner game pieces positioned within Paradice. As such, functionality and ownership of the inner game pieces in Paradice are in a constant state of change relative to the change of position of the Circumstance Changer 410.

In some embodiments, the mask 415, referred to the Taker Mask, is used to indicate the Taker's playing piece for a round. Accordingly, the mask can be placed on and taken off any colored human-being game piece 420 during the beginning of each round of the game play.

Figure 6:
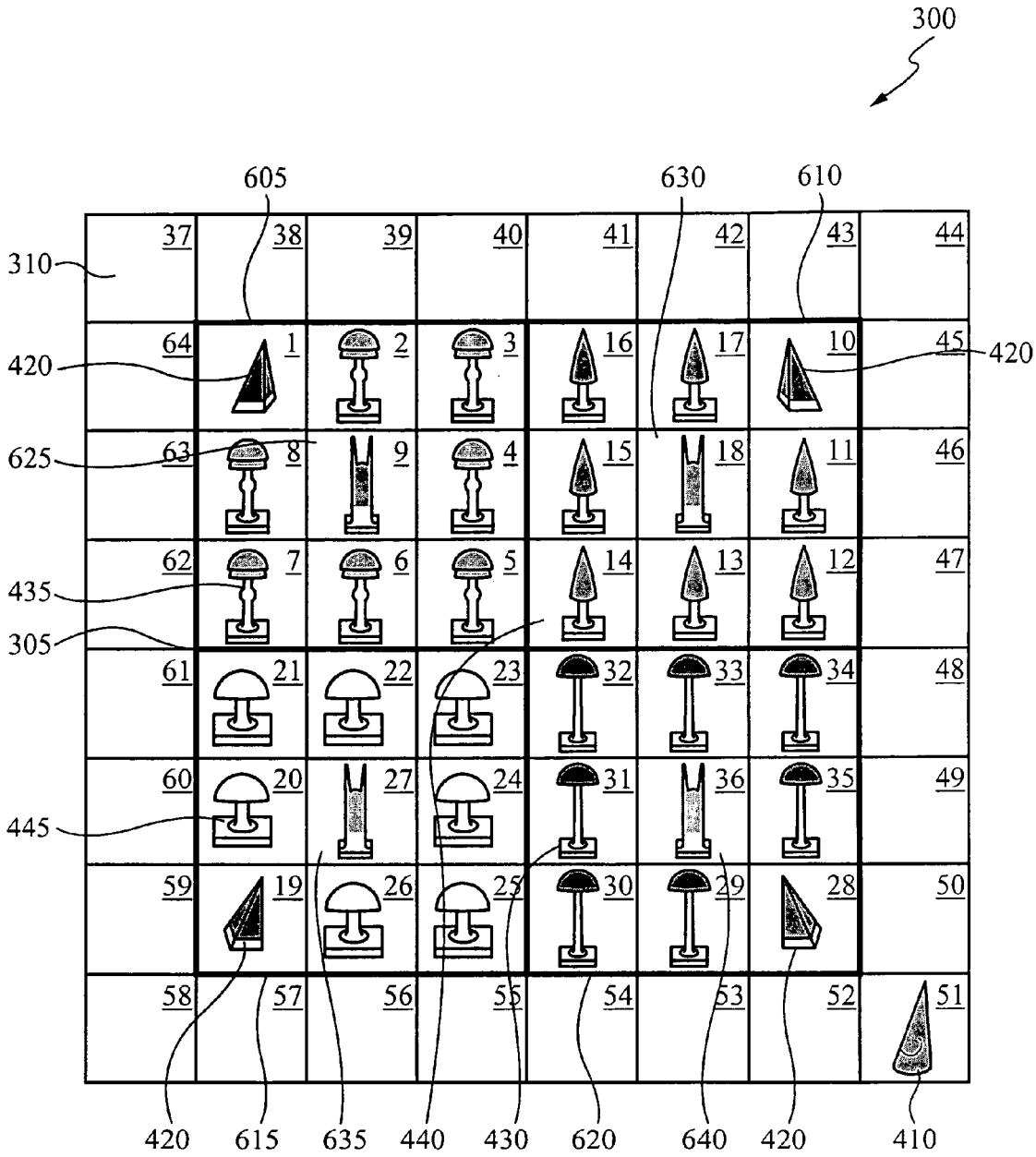
FIG. 6 illustrates a starting configuration of the game pieces on the game board of the gaming apparatus as illustrated in FIG. 4.

FIG. 6 illustrates an exemplary starting configuration of the game pieces on the game board 300. Positions of the game pieces illustrated in FIG. 6 are referenced according to the square numbers shown in FIG. 3. For example, the Universe Interface 310 includes squares 37-64, all of which are empty except for one square 51 in this example, which is occupied by the Circumstance Changer 410. It is understood that the starting position of the Circumstance Changer shown in FIG. 6 is for exemplary purposes only. Accordingly, the starting position of the Circumstance Changer can be any square 37-64 within the Universe Interface 310.

As mentioned above, Paradice 305 is divided into four quadrants 605, 610, 615, 620. Each quadrant in Paradice 305 comprises seven forest trees of one type supporting a colored forest spirit and a colored human-being observing the world from a Point of View. Preferably, a first colored forest spirit associated with a first type of forest tree is placed in the center of a quadrant. A colored human-being game piece is placed in the outer corner of the quadrant, with the front looking inward towards the center of the game board 300. The orientation of the colored human-being game piece is significant, as will be described in greater detail below. The seven forest trees of the first type are placed in the rest of the squares of the quadrant. During the game play, the colored forest spirit must be next to a tree of its forest to be active (flourishing).

For example, as FIG. 6 illustrates, a Palm forest in the first quadrant 605 includes seven Palm trees 435, a yellow Palm spirit 625, and a human-being game piece 420. The yellow Palm spirit 625 is positioned on the square 9. One human-being game piece 420 is positioned on the square 1, looking inward towards the center of the game board 300. One Palm tree 435 is positioned on each of the squares 2-8. A Coniferous forest in the second quadrant 610 includes seven Coniferous trees 440, a violet Coniferous spirit 630, and a human-being game piece 420. The violet Coniferous spirit 630 is positioned on the square 18. One human-being game piece 420 is positioned on the square 10, looking inward towards the center of the game board 300. One Coniferous tree 440 is positioned on each of the squares 11-17. A Deciduous forest in the third quadrant 615 includes seven Deciduous trees 445, an orange Deciduous spirit 635, and a human-being game piece 420. The orange Deciduous spirit 635 is positioned on the square 27. One human-being game piece 420 is positioned on the square 19, looking inward towards the center of the game board 300. One Deciduous tree 445 is positioned on each of the squares 20-26. A Rainforest in the fourth quadrant 620 includes seven Rainforest trees 430, a red Rainforest spirit 640, and a human-being game piece 420. The red Rainforest spirit 640 is positioned on the square 36. One human-being game piece 420 is positioned on the square 28, looking inward towards the center of the game board 300. One Rainforest tree 430 is positioned on each of the squares 29-35. The relative positions of each of the forests illustrated in FIG. 6 are for exemplary purposes only, and each forest can be initially positioned within any of the four quadrants within Paradice 305. Accordingly, it is understood that the starting positions of the forests are randomly selected by the players.

II. Method for Game Play

The present invention is preferably configured for a two-person game play. During the game play, each player alternatively takes on a role, referred to as a Point of View. A player's Point of View is either a Taker or a Giver. Preferably, each Point of View has an aim and strategy. As the Taker, the player's aim to prevent the four colored human-beings from meeting Eye to Eye by removing all trees from at least two forests and disrupting the colored human-beings from coming together. Preferably, when all trees from at least two forests are removed from Paradice, the Giver can no longer win. The Taker's aim is also to become the Giver during game play for a chance to win the game play. In contrast, as the Giver, the player's aim is to move all four colored human-being game pieces together to meet Eye to Eye and form a pyramid before at least two complete forests are removed from Paradice by the Taker. Preferably, only the Giver can win the game play, and the Giver can only win the game play when all four colored human-being game pieces meet Eye to Eye by forming the pyramid.

Figure 7:
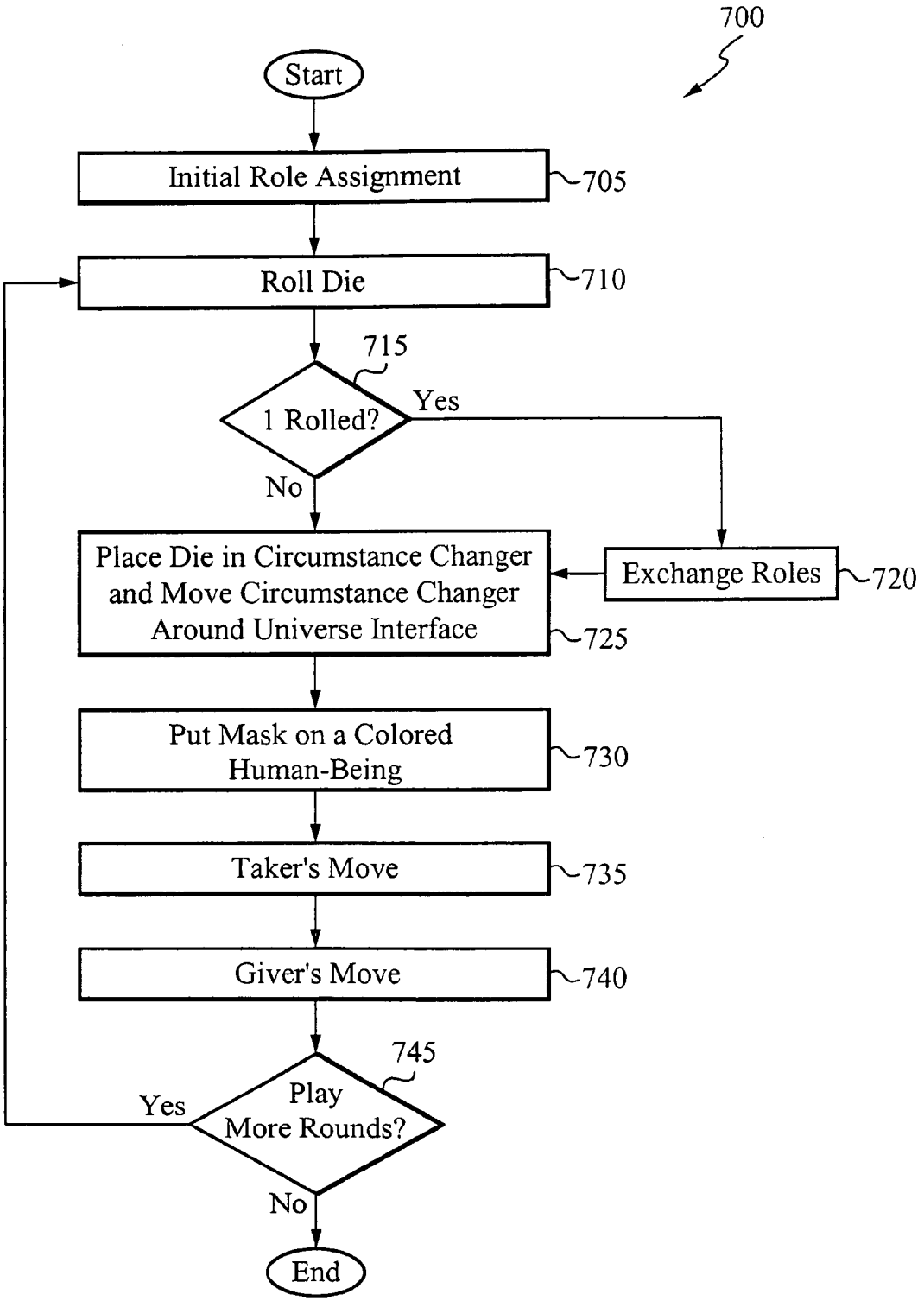
FIG. 7 illustrates a method of playing the game play of the present invention.

FIG. 7 illustrates an exemplary process 700 for a game play. The process 700 begins at the step 705, where each player is assigned an initial role based on the roll of the die. The number of the rolled die is referred to as an Opportunity. Each player rolls the die, and the player with the lower Opportunity starts the game as the Taker. The other player starts the game as the Giver.

The game play is divided into a series of rounds. Typically, rounds are repeated until the game play ends. Preferably, each round of the game play includes three parts. In the first part of a round, the process 700 transitions to the step 710, where the Taker rolls the die. The process 700 transitions to the step 715, where the Opportunity for the round is determined. If the Opportunity is a one, the process 700 transitions to the step 720, where the players exchange Points of View before the round continues. The original Giver now becomes the new Taker, and the original Taker now becomes the new Giver. This will result in a player having two turns in a row since the Giver had the last move in the previous round, and becomes the Taker, having the first move in the new round. One remains as the Opportunity for the round. Then, the process 700 transitions to the step 725.

If it is determined at the step 715 that the Opportunity is not a one, the process 700 directly transitions to step 725, where the die is placed on the base portion of the Circumstance Changer with the Opportunity up, and the Giver moves the Circumstance Changer around the Universe Interface by the Opportunity. In some embodiments, the Circumstance Changer moves clockwise around the Universe Interface. The Taker and Giver both have the same Opportunity, or number of moves, per round.

The process 700 transitions to the step 730, where the Taker Mask is placed on a colored human-being game piece nearest to the repositioned Circumstance Changer according to step 725. The "nearest" is determined by counting squares in either direction but not diagonally. As such, if the Circumstance Changer stops equidistant between the masked human-being and an unmasked colored human-being, the Taker chooses which one to mask with the Taker Mask. If the Circumstance Changer stops equidistant between two unmasked colored human-beings that are nearer than the masked human-being, the Taker chooses which of the two unmasked human-beings to mask with the Taker Mask. This newly masked human-being indicates the Taker's playing piece for the round.

In some embodiments, the Taker moves first before the Giver moves in a round. Accordingly, when the process 700 transitions to the step 735, the Taker starts the second part of the round. In some embodiments, the Taker moves the masked human-being game piece one square horizontally or vertically but not diagonally per Opportunity number. The Taker removes the forest trees from Paradice by moving the masked human-being game piece onto squares occupied by the forest trees. When all the trees of a forest spirit's forest are removed from Paradice, the forest spirit and a nearest unmasked human-being are deactivated (floundering). Deactivation is discussed in greater detail below.

Alternatively, the Taker displaces unmasked colored human-being game pieces or colored forest spirit game pieces by moving the masked human-being game piece onto squares occupied by them and changing position with them. When a colored forest spirit is separated from the trees of its forest, the forest spirit and a nearest unmasked human-being are also deactivated.

As mentioned above, the Taker deactivates colored forest spirits and unmasked colored human-beings nearest to them by taking all the trees of a colored forest spirit's forest or by separating a colored forest spirit from the trees of its forest. In Paradice, the forest spirits are the sustaining energy for the human-beings. Accordingly, when a colored forest spirit is deactivated, a nearest unmasked colored human-being to it is also deactivated in the same move. When the colored forest spirit is deactivated and is equidistant between two unmasked colored human-beings, the Taker chooses which colored human-being to deactivate. The colored forest spirit game piece and the nearest unmasked colored human-being game piece to it are replaced with their transparent counterparts. The transparent counterparts designate deactivated forest spirits and/or human-beings. Preferably, the transparent human-being game piece faces the same direction as the unmasked colored human-being game piece it replaces.

Alternatively, the Taker disrupts groups of unmasked colored human-beings meeting Eye to Eye by displacing one or more of the group by using the masked human-being. The Taker can displace more than one unmasked colored human-being game pieces in a turn, if they are in close proximity and the Taker has available moves. A masked human-being game piece faces the same direction at the end of a move as at the start. However, the masked human-being game piece can rotate 90 degrees in orientation, which would cost the Taker one move.

Alternatively, the Taker resets the game play in order to become the Giver by removing all the trees from at least two forests from Paradice. This automatically deactivates two colored forest spirits and two colored human-beings. Accordingly, the Giver can no longer win the game play, and the game is reset for another game play.

When the Taker uses up the available number of moves, the process 700 transitions to the step 740, where the Giver starts the third part of the round. The Giver uses the same Opportunity presented to the Taker in the second part of the round. Preferably, the Giver uses any of the unmasked colored human-being game pieces, or any of the colored forest spirit game pieces, or a combination of these pieces in a single turn. In some embodiments, the Giver moves an unmasked colored human-being game piece or a colored forest spirit game piece one square in any direction but not diagonally per Opportunity number. Unmasked colored human-being game pieces can move onto occupied or unoccupied squares. If the square is occupied, the unmasked colored human-being game piece displaces the game piece on that square by changing positions. In some embodiments, colored forest spirit game pieces cannot displace. Accordingly, colored forest spirit game pieces can only move onto unoccupied squares. In some embodiments, the Giver removes only transparent pieces from Paradice. As such, the Giver cannot remove forest trees from Paradice. Removing and replacing transparent pieces are discussed in greater detail below.

Alternatively, the Giver gives forest trees back to Paradice when human-beings come together to meet Eye to Eye. Since the life of the human-being, the forest spirit, and the forest are all dependent upon one another, the forest spirit cannot survive if there are no trees. The trees cannot survive if there are no human-beings meeting Eye to Eye. As such, when two human-beings meet Eye to Eye, the Giver gives one tree back to its forest for each available move. When three human-beings meet Eye to Eye, the Giver gives one tree back to its forest for each available move plus one additional tree. The returned forest tree is placed next to its corresponding colored forest spirit or another forest tree of its type. In some embodiments, when a tree is given back to a forest, it can only be placed adjacent to a tree of the same type but in any quadrant. Preferably, forest trees can be replaced in any order or combination. For example, if two forest trees are to be replaced, the replaced forest trees can be one Palm tree and one Deciduous tree.

In addition, when three human-beings meet Eye to Eye, the Giver can move the masked human-being into the pyramid, turn the masked human-being if necessary to meet the unmasked human-beings Eye to Eye, and move it into the fourth position of the pyramid, provided there are sufficient moves available. A colored human-being typically faces the same direction at the end of a move as at the start. However, a colored human-being game piece can rotate 90 degrees in orientation, which would costs the Giver one move.

Alternatively, the Giver reactivates (restores) deactivated or transparent pieces. In some embodiments, the Giver reactivates both the deactivated forest spirit and the deactivated human-being with it in the following single move. For example, when two or three human-beings are together Eye to Eye, the Giver reactivates a deactivated forest spirit either by placing a tree of the forest spirit's type next to the transparent forest spirit all in the same move or by moving the deactivated forest spirit next to a tree of its forest. However, with no human-beings Eye to Eye, the Giver only reactivates a deactivated forest spirit by moving it next to a tree of its forest. Since a forest spirit is active when it is adjacent to or touching diagonally at least one tree of its forest, the tree preferably is adjacent or diagonally next to its forest spirit. When a forest spirit is reactivated, the transparent forest spirit and transparent human-being deactivated with it are replaced with the original colored forest spirit and a colored human-being. The colored human-being game piece must face the same direction as the transparent one it replaces.

When the Giver uses up the available number of moves, the process 700 transitions to the step 745, where it is determined whether another round is needed to complete the game play. The game play ends when the Giver successfully makes all four colored human-beings meet Eye to Eye, in which the Giver wins the game play. Alternatively, the game play ends when the Taker successfully resets the game play by removing all trees from at least two forests. By resetting the game, the players change their Points of View, that is the original Taker becomes the new Giver, and the original Giver becomes the new Taker; and the inner game pieces are reset to an initial starting position, such as the one illustrated in FIG. 6. Otherwise, the game play continues by the Taker rolling the die to start a new round. If it is determined that another round is needed to complete the game play at the step 745, the process 700 transitions to the step 710.

In subsequent rounds, if the Circumstance Changer lands nearer to a different colored human-being game piece than the human-being wearing the Taker Mask in the previous round, the Taker Mask is placed on the closer colored human-being game piece. The closer colored human-being game piece, now wearing the Taker Mask, becomes the Taker's playing piece for the next round.

In an alternative embodiment, the Giver moves first before the Taker moves in a round. In this case, the steps 735 and 740 in FIG. 7 are reversed.

Figure 8:
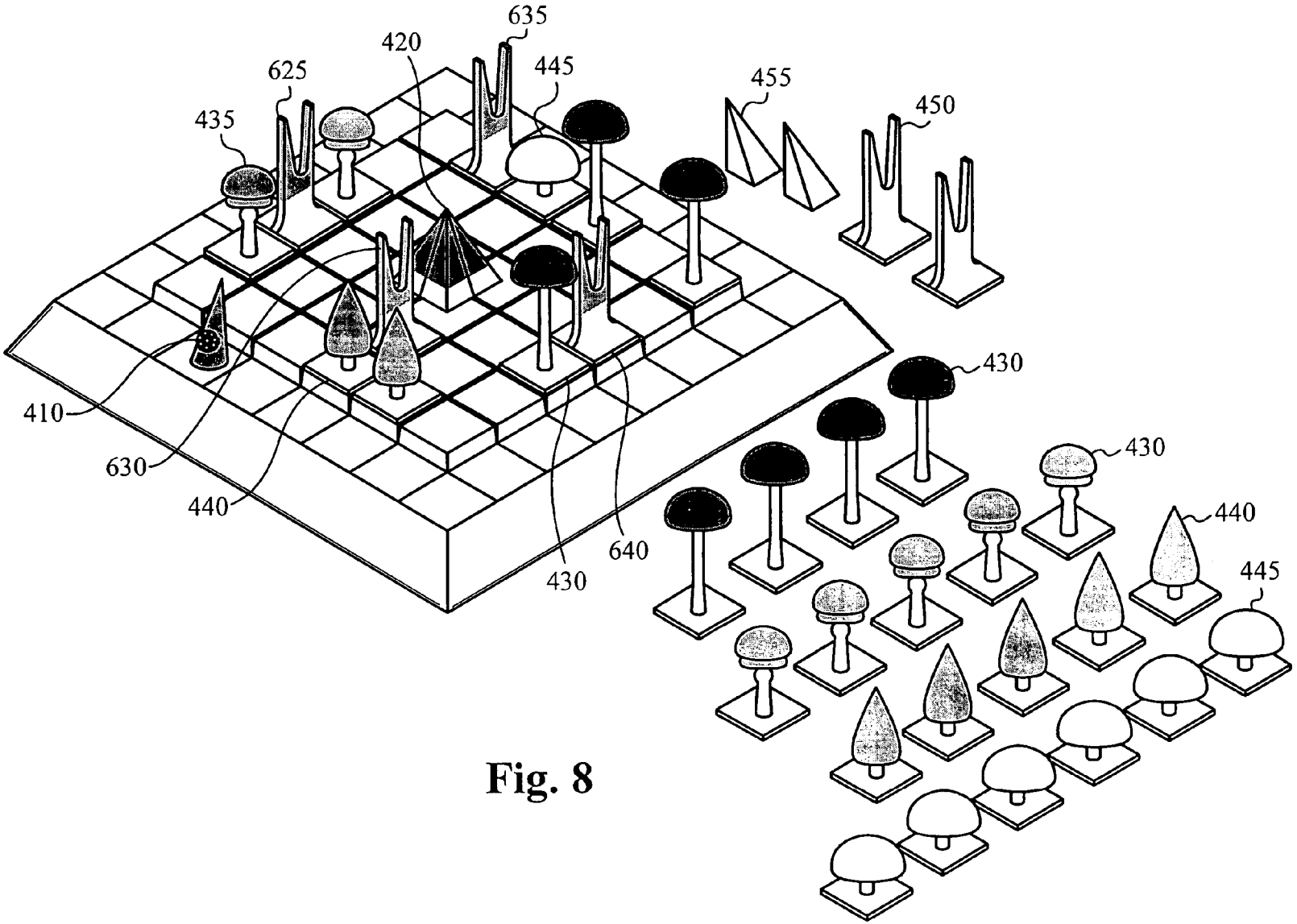
FIG. 8 illustrates an exemplary game pieces configuration of the gaming apparatus in which the Giver wins the game play.

FIG. 8 illustrates an exemplary game pieces configuration in which the Giver wins the game play. As illustrated in FIG. 8, there is at least one tree from at least three forests standing next to its colored forest spirit in Paradice. Two Palm trees 435 are next to the yellow Palm spirit 625. Two Coniferous trees 440 are next to the violate Coniferous spirit 630. One Rainforest tree 430 is next to the red Rainforest spirit 640. One Deciduous tree 445 is next to the orange Deciduous spirit 635. Two transparent forest spirit game pieces 450 and two transparent human-being game pieces 455 are removed from Paradice. Furthermore, the four colored human-being game pieces 420 are adjacently positioned so that each of the four colored human-being game pieces touch each other and meet Eye to Eye, thereby forming the pyramid. It is understood that the relative positions of playing pieces illustrated in FIG. 8 is for exemplary purposes only. There are many possibilities of how the Giver may win the game play.

Figure 9:
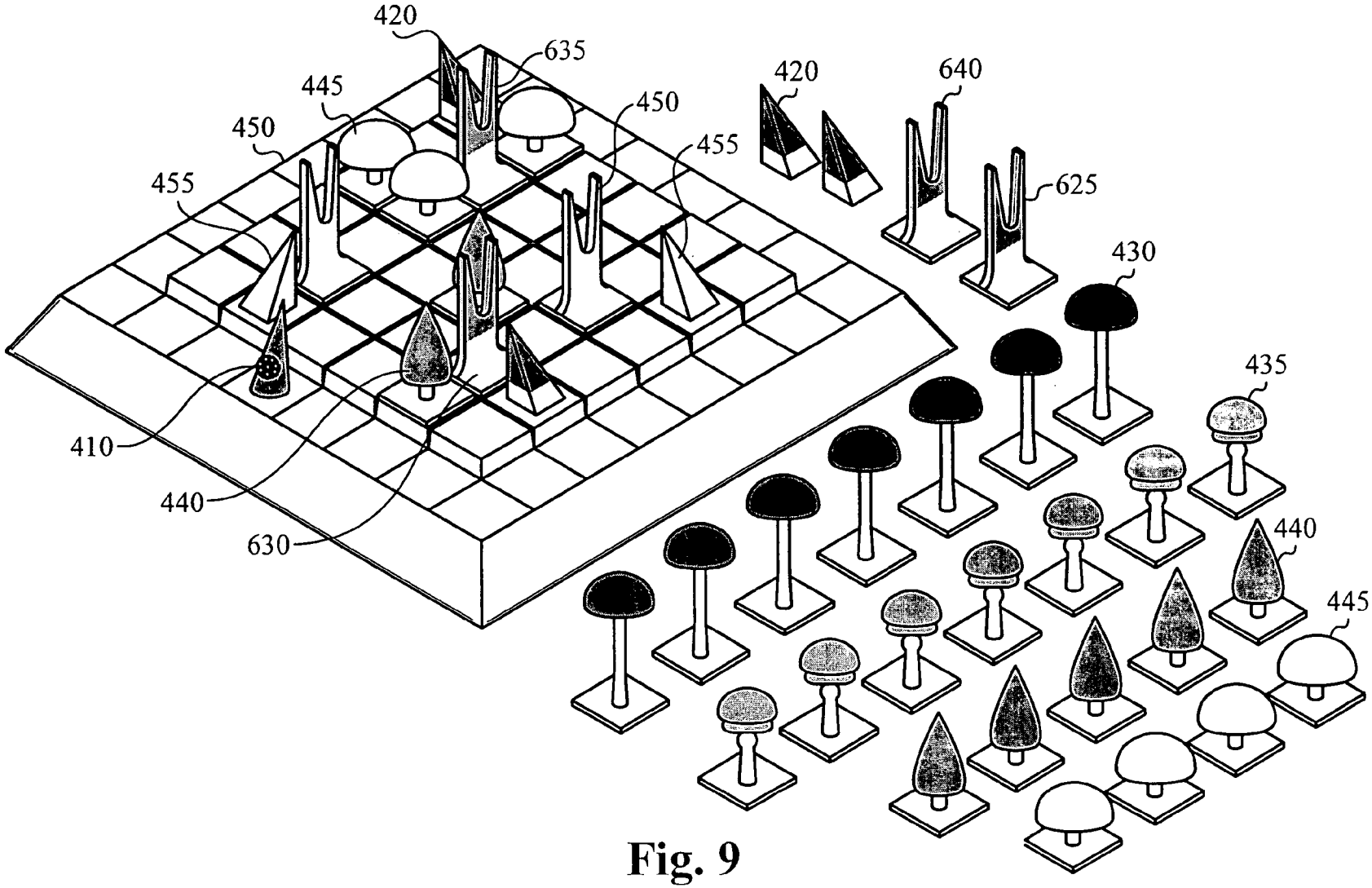
FIG. 9 illustrates an exemplary game pieces configuration of the gaming apparatus in which the Taker prevents the Giver from winning the game play.

FIG. 9 illustrates an exemplary game pieces configuration in which the Taker prevents the Giver from winning the game play. As illustrated in FIG. 9, all of the seven Rainforest trees 430 and all of the seven Palm trees 435 are taken off the board. As such, the red Rainforest spirit 640 and the nearest unmasked colored human-being 420 are deactivated and are replaced by their transparent counterparts. The yellow Palm spirit 625 and the nearest unmasked colored human-being 420 are likewise deactivated and are replaced by their transparent counterparts. Even though the orange Deciduous spirit 635 and the violet Coniferous spirit 630 are still active, the Giver can no longer win since all trees from at least two forests have been removed and because there is no human-being with whom to be Eye-to-Eye. It is understood that the relative positions of playing pieces illustrated in FIG. 9 is exemplary purposes only. There are many possibilities of how the Taker may prevent the Giver from winning the game play.

The present invention has been described in terms of specific embodiments incorporating details to facilitate the understanding of principles of construction and operation of the invention. Such reference herein to specific embodiments and details thereof is not intended to limit the scope of the claims appended hereto. A person skilled in the art would appreciate that various modifications and revisions to the gaming apparatus will occur. Consequently, the claims should be broadly construed, consistent with the spirit and scope of the invention, and should not be limited to their exact, literal meaning.

I claim:

1. A gaming apparatus for a plurality of players, the gaming apparatus comprising:

a. a plurality of game pieces comprising:

1. a plurality of first game pieces designated by a first type;
2. a plurality of second game pieces designated by a second type;
3. a plurality of third game pieces designated by a third type;
4. a plurality of fourth game pieces designated by a fourth type;
5. a plurality of fifth game pieces designated by a fifth type, each having a protrusion on a first flat surface and a socket on a second flat surface, wherein the socket of a fifth game piece is configured to receive the protrusion of another fifth game piece;
6. a plurality of sixth game pieces designated by a sixth type, wherein each one of the plurality of the sixth game pieces is a transparent counterpart to one of the plurality of the fifth game pieces;
7. a plurality of seventh game pieces designated by a seventh type, wherein a first one of the seventh game pieces is associated with the plurality of first game pieces, a second one of the seventh game pieces is associated with the plurality of second game pieces, a third one of the seventh game pieces is associated with the plurality of third game pieces, and a fourth one of the seventh game pieces is associated with the plurality of fourth game pieces; and
8. a plurality of eighth game pieces designated by an eighth type, wherein each one of the plurality of the eighth game pieces is a transparent counterpart to one of the plurality of the seventh game pieces; and b. a game board with playing surface, wherein the playing surface comprising:

1. an inner play area, wherein the inner play area is configured for positioning inner game pieces; and 2. an outer play area, wherein the outer play area surrounds the inner play area, wherein the outer play area is configured for positioning an at least one outer game piece.

2. The gaming apparatus of claim 1, wherein the inner game pieces comprise the plurality of the first game pieces, the plurality of the second game pieces, the plurality of the third game pieces, the plurality of the fourth game pieces, the plurality of the fifth game pieces, the plurality of the sixth game pieces, the plurality of the seventh game pieces, and the plurality of the eighth game pieces.

3. The gaming apparatus of claim 1, wherein the plurality of first game pieces is designated as a first type of tree, the plurality of second game pieces is designated as a second type of tree, the plurality of third game pieces is designated as a third type of tree, and the plurality of fourth game pieces is designated as a fourth type of tree.

4. The gaming apparatus of claim 1, wherein each one of the plurality of fifth game pieces is shaped as one-quarter of a pyramid, wherein the plurality of fifth game pieces interlocks at protrusions and sockets to form the pyramid.

5. The gaming apparatus of claim 1, wherein the first one of the seventh game pieces is designated by a first color, the second one of the seventh game pieces is designated by a second color, a third one of the seventh game pieces is designated by a third color, and the fourth one of the seventh game pieces is designated by a fourth color.

6. The gaming apparatus of claim 1, wherein the plurality of game pieces further comprises a ninth game piece, the ninth game piece is the at least one outer game piece positioned within the outer play area, the position is configured to determine movement of the plurality of the inner game pieces within the inner play area.

7. The gaming apparatus of claim 6, wherein the plurality of game pieces further comprising a tenth game piece, the tenth game piece is stored inside the at least one outer game piece and is configured to determine a position of the at least one outer game piece within the outer play area.

8. The gaming apparatus of claim 7, wherein the plurality of game pieces further comprising an eleventh game piece, the eleventh game piece is configured to indicate one of the plurality of fifth game pieces.

9. The gaming apparatus of claim 1, wherein the inner playing area is a raised surface, wherein the inner playing area comprises four quadrants, each quadrant having a 3×3 array of squares.

10. The gaming apparatus of claim 1, wherein the outer playing area comprises an array of squares.

11. A method of game play using a plurality of inner game pieces, at least one outer game piece, and a game board including an outer play area and inner play area having an array of locations divided into four quadrants, the method comprising:

a. positioning the plurality of inner game pieces within the inner play area of the game board and the at least one outer game piece within the outer play area of the game board, thereby positioning each of a first group of the plurality of inner game pieces at a corner of the inner play area, wherein the first portion of the plurality of inner game pieces adjacently positioned is configured to form a pyramid, positioning each of a second group of the plurality of the inner game pieces at the center of each quadrant, positioning each of a third group of the plurality of inner game pieces in a first quadrant surrounding a first one of the second portion of the plurality of the inner game pieces, positioning each of a fourth group of the plurality of inner game pieces in a second quadrant surrounding a second one of the second portion of the plurality of the inner game pieces, positioning each of a fifth group of the plurality of the inner game pieces in a third quadrant surrounding a third one of the second portion of the plurality of the inner game pieces, and positioning each of a sixth group of the plurality of the inner game pieces in a fourth quadrant surrounding a fourth of the second portion of the plurality of the inner game pieces;

b. initially assigning a first player a first role and a second player a second role, wherein a goal of the second role is to form the pyramid to win the game play;

c. randomly generating a number to play a round;

d. switching the roles between the first player and the second player when the generated number is a predetermined value;

e. moving the at least one outer game piece within the outer play area by the generated number;

f. the player assigned with the first role masking one of the first portion of the plurality of inner game pieces to define a masked game piece and moving the masked game piece by the generated number, wherein the masked game piece is determined by a resting position of the at least one outer game piece within the outer play area, and wherein moving the masked game piece to an occupied location displaces or removes an inner game piece positioned at the occupied location from the inner play area;

g. the player assigned with the second role moving one or more inner game pieces other than the masked game piece by the generated number, thereby advancing towards the formation of the pyramid; and h. repeating the steps c-g until a predetermined terminating step is obtained, wherein the predetermined terminating step includes forming the pyramid.

12. The method of claim 11, wherein moving the at least one outer game piece forms the resting position of the at least one outer game piece within the outer play area, wherein functionality of each of the inner game pieces is determined by the resting position of the at least one outer game piece within the outer play area.

13. The method of claim 11, further comprising returning a removed game piece to the inner play area upon positioning at least two game pieces of the first portion of the plurality of inner game pieces adjacently together.

14. The method of claim 11, wherein displacement occurs when the masked game piece exchanges position with the inner game piece positioned at the occupied location.

15. The method of claim 11, wherein the predetermined terminating step is achieved when the first group of the plurality of inner game pieces, each shaped as one-quarter of a pyramid having a locking mechanism, is moved by the player assigned with the second role to locations of the array such that the first group of the plurality of inner game pieces is positioned adjacently in a specific orientation to interlock together to form the pyramid.

16. The method of claim 15, wherein the step g includes rotating a game piece of the first group of the plurality of inner game pieces in order to interlock with another of the first group of the plurality of inner game pieces.

17. The method of claim 11, wherein the predetermined terminating step is achieved when all inner game pieces from at least two portions selected from the third group, the fourth group, the fifth group, and the sixth group of the plurality of inner pieces are removed from the inner play area by the player assigned with the first role.

18. The method of claim 11, the method for game play further comprises replacing one or more of the plurality of inner game pieces with another one or more of the plurality of inner game pieces.

19. A game set comprising:

a. a game board comprising an outer play area surrounding an inner play area, wherein the inner play area comprises four N×N quadrants;

b. a plurality of outer game pieces configured to be played on the outer play area comprising:

1. a die; and
2. a holder configured to carry the die during game play; and c. a plurality of inner game pieces configured to be played on the inner play area comprising:

1. a plurality of first inner game pieces each shaped as a tree of a first type;
2. a plurality of second inner game pieces each shaped as a tree of a second type;
3. a plurality of third inner game pieces each shaped as a tree of a third type;
4. a plurality of fourth inner game pieces each shaped as a tree of a fourth type;
5. a plurality of fifth inner game pieces each shaped as a colored one-quarter of a pyramid with a protrusion on a first side and a socket on an adjacent side, wherein the socket of a fifth game piece is configured to receive the protrusion of another fifth game piece, wherein the plurality of fifth game pieces interlocks at protrusions and sockets to form the pyramid;
6. a plurality of sixth inner game pieces each shaped as a transparent one-quarter of the pyramid;
7. a plurality of seventh inner game pieces each shaped as a colored vertically-elongated member, wherein a first one of the seventh inner game pieces is associated with the plurality of first inner game pieces, a second one of the seventh game pieces is associated with the plurality of second inner game pieces, a third one of the seventh game pieces is associated with the plurality of third inner game pieces, and a fourth one of the seventh game pieces is associated with the plurality of fourth inner game pieces;
8. a plurality of eighth inner game pieces each shaped as a transparent vertically-elongated member; and
9. a covering piece configured to couple to any one of fifth game piece.

* * * * *